US008740827B2

(12) United States Patent
Wu

(10) Patent No.: US 8,740,827 B2
(45) Date of Patent: Jun. 3, 2014

(54) HEAD MASSAGER AND ITS HELMET

(75) Inventor: Xuliang Wu, Shenzhen (CN)

(73) Assignee: Shenzhen Breo Technology Co., Ltd., Shenzhen (CN)

( * ) Notice: Subject to any disclaimer, the term of this patent is extended or adjusted under 35 U.S.C. 154(b) by 808 days.

(21) Appl. No.: 13/007,925

(22) Filed: Jan. 17, 2011

(65) Prior Publication Data

US 2011/0112448 A1 May 12, 2011

Related U.S. Application Data

(63) Continuation of application No. PCT/CN2008/073251, filed on Nov. 28, 2008.

(30) Foreign Application Priority Data

Oct. 15, 2008 (CN) ..... 2008 1 0216849

(51) Int. Cl.
*A61H 9/00* (2006.01)
*A42B 3/00* (2006.01)

(52) U.S. Cl.
USPC ..... 601/148; 601/84; 2/413; 2/417

(58) Field of Classification Search
USPC ..... 601/23, 26, 33, 46, 49, 67, 69, 70, 741, 601/74, 84, 85, 87, 88, 89, 90, 92, 93, 96, 601/105, 134, 136, 143, 144, 148–152; 2/8.1, 10, 181, 183, 413, 416–422
See application file for complete search history.

(56) References Cited

U.S. PATENT DOCUMENTS

| | | | | |
|---|---|---|---|---|
| 5,357,654 | A | 10/1994 | Hsing-Chi | |
| 2006/0015986 | A1 | 1/2006 | Bielefeld | |
| 2007/0088234 | A1 * | 4/2007 | Tseng | 601/151 |
| 2010/0050325 | A1 * | 3/2010 | Wang-Lee | 2/418 |
| 2010/0095438 | A1 * | 4/2010 | Moelker | 2/418 |
| 2011/0265254 | A1 * | 11/2011 | Ma et al. | 2/420 |
| 2012/0296245 | A1 * | 11/2012 | Ma et al. | 601/84 |

FOREIGN PATENT DOCUMENTS

| | | |
|---|---|---|
| CN | 1255836 | 6/2000 |
| CN | 200939230 | 8/2007 |
| CN | 101040815 | 9/2007 |
| CN | 101045028 | 10/2007 |
| CN | 200977266 | 11/2007 |

* cited by examiner

*Primary Examiner* — Quang D Thanh
(74) *Attorney, Agent, or Firm* — Hamre, Schumann, Mueller & Larson, P.C.

(57) ABSTRACT

A head massager comprises a helmet having a front shell and a rear shell moveable relative to the front shell, a massage device and an adjustment device having a positive rotatable knob, a fixing pole fixed on the rear shell, a winding ring, two pulling ropes and a reverse locking device. The rear shell has a cavity and the front shell has two ends plug-connected with two ends of the rear shell. The knob and the winding ring are loosely sleeved on the fixing pole via holes. The knob has first bulged teeth around a hole, the winding ring has a loop of second bulged teeth around another hole. The first bulged teeth are indented joined to the second bulged teeth. One end of each pulling rope is connected to the end of the front shell, another end of the pulling rope is connected to the winding ring to rotate the knob in positive direction for moving the front shell by the two pulling ropes.

19 Claims, 12 Drawing Sheets

HEAD MASSAGER AND ITS HELMET

TECHNICAL FIELD

The present invention relates to health massage apparatus and, more particularly to a head massager having a massage function for head.

BACKGROUND

A head massager is used for carrying out a massage on the head of a user, and generally includes a helmet and a massage device. The helmet is worn on the head of the user, and the massage device is disposed on the helmet and is used for achieving a massage on the head of the user. For fit on the heads of the users with various sizes of head circumferences, the helmet generally has a first helmet body and a second helmet body which are movable with respect to each other. Two joints of the first helmet body and the second helmet body are respectively provided with an adjustment device. The adjustment device usually utilizes a gear rack mechanism to drive the first helmet body and the second helmet body to move relative to one another. However, this structure has the following shortages: requiring two adjustment devices, and relatively smaller adjustable range since the two adjustment devices form mutual constraint during adjusting operation.

SUMMARY

A problem to be solved in accordance with the present invention, for overcoming shortages in the art, is to provide a head massager, which has a compact structure and is easy to adjust in a relatively larger adjustable range.

A technical solution in accordance with the present invention is adopted for resolving the problem is that: a head massager comprises a helmet, a massage device disposed on the helmet and an adjustment device. The helmet has a front shell and a rear shell which is movable relating to the front shell. The rear shell has a shell cavity. Two ends of the front shell are plug-connected with two ends of the rear shell. The adjustment device includes a positive rotatable knob, a fixing pole, a winding. ring, two bundles of pulling ropes and a reverse locking device for preventing the knob from rotating reversely. The fixing pole is fixed on the rear shell. Both the knob and the winding ring are loosely sleeved on the fixing pole through through holes. The knob is provided with a loop of first bulged teeth around its through hole, and the winding ring is provided with a loop of second bulged teeth around its through hole correspondingly. The first bulged teeth and the second bulged teeth have a mating status and a separated status. One end of each bundle of pulling rope is connected to one end of the front shell and the other end of each bundle of pulling rope is connected to the winding ring, so that both the two bundles of pulling ropes pull the front shell while the first bulged teeth engages with the second bulged teeth and the knob rotates along a positive direction.

Preferably, the knob is provided with a mounting pole, and the adjustment device further includes a snap spring which is mounted on the mounting pole. The snap spring has two resilient fastening arms which clamp the fixing pole. The fixing pole includes a head portion with a larger exterior diameter and a stem portion with a smaller exterior diameter. A neck portion is formed at a joint of the head portion and the stem portion. The two fastening arms of the snap spring clamp the neck portion. The stem portion is fixed to the rear shell, and the knob and the winding ring are loosely sleeved on the stem portion.

Preferably, the rear shell includes an inner shell and an exterior shell secured together. A shell cavity is defined between the inner shell and the exterior shell. Both ends of the front shell are respectively provided with a slide plate which is inserted into the shell cavity. The pulling rope is connected to the slide plate. The adjustment device further includes a nut. The stem portion is provided with a threaded section. The nut is fixed to the inner shell. The threaded section of the stem portion is threaded to the nut.

Preferably, the rear shell has an aperture communicating with the shell cavity. The fixing pole and the winding ring are installed into the shell cavity via the aperture. The knob is at least partially disposed outside the shell cavity. The reverse locking device includes at least one locking bar disposed on the knob and a loop of locking teeth disposed on the rear shell around the aperture. The locking bar engages with the locking teeth. The knob defines at least two anti-collision holes surrounding the through hole thereof. Wall which defines each anti-collision hole is provided with one locking bar extending therefrom in a cantilever form.

Preferably, at least one of the front shell and the rear shell is provided with a flexible liner fixed to an internal side thereof. An air bag which includes a first air bag and two second air bags is provided within the liner. The first air bag defines two fastening holes, and the two second air bags are disposed on an internal side of the first air bag. Gas nozzles of the two second air bags are fastened to rims of the two fastening holes by exterior edges thereof, respectively. The first air bag includes a gas intaking portion and mounting portions all separated from the intaking portions through separate tapes. The fastening holes are defined in the mounting portions.

A helmet of a head massager includes a front shell, a rear shell which is movable relating to the front shell, and an adjustment device. The rear shell has a shell cavity. Two ends of the front shell are plug-connected with two ends of the rear shell. The adjustment device includes a positive rotatable knob, a fixing pole, a winding ring, two bundles of pulling ropes and a reverse locking device for preventing the knob from rotating reversely. The fixing pole is fixed on the rear shell. Both the knob and the winding ring are loosely sleeved on the fixing pole through through holes. The knob is provided with a loop of first bulged teeth around its through hole, and the winding ring is provided with a loop of second bulged teeth around its through hole correspondingly. The first bulged teeth engage with the second bulged teeth. One end of each bundle of pulling rope is connected to one end of the front shell and the other end of each bundle of pulling rope is connected to the winding ring, so that both the two bundles of pulling ropes pull the front shell while the knob rotates along a positive direction.

Advantageous effects of the present invention is: 1) while rotating the knob, the knob leads the winding ring to rotate and the pulling ropes are retracted accordingly, and thereby the entire front shell is pulled toward the rear shell. This carries out adjustment of space of the head circumference. This structure is compact and is easy to adjust in a larger adjustable range; 2) a position indication is provided by the snap spring while the knob is pulled up and pressed down along the fixing pole; 3) massage effect on the head will be enhanced by the engaged first and second air bags.

DETAILED DESCRIPTION OF THE EMBODIMENTS

Figure 1:
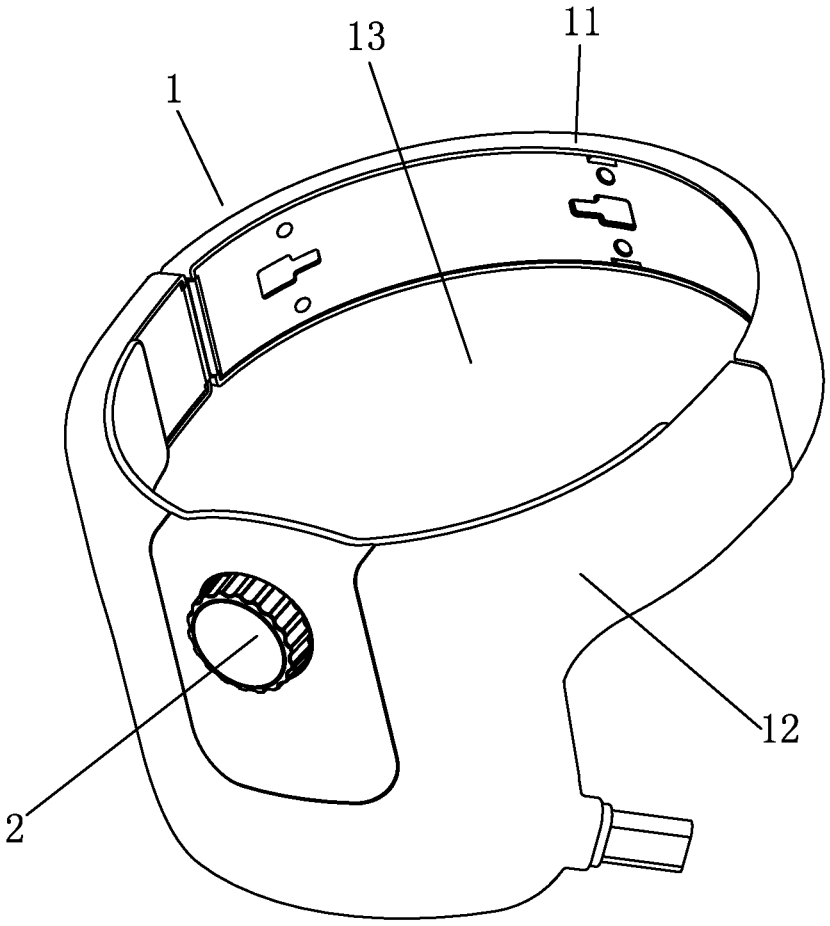
FIG. 1 is a perspective view of a head massager (without liner) after adjusting in accordance with an embodiment of the present invention.
Figure 2:
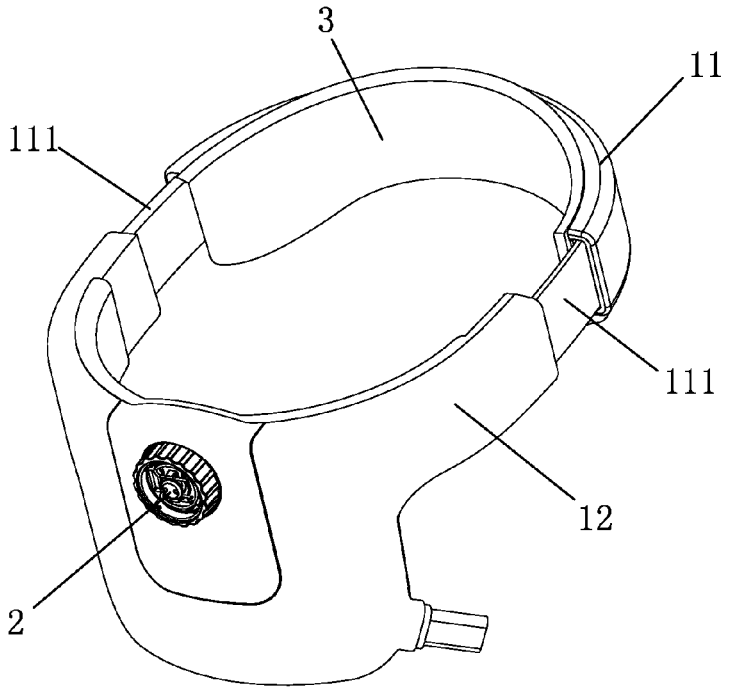
FIGS. 2 and 3 are perspective views of a head massager before adjusting from two angles of view respectively in accordance with the embodiment of the present invention.

As shown in FIG. 1 through FIG. 20, a head massager of an embodiment of the present invention comprises a helmet 1 and a massage device. The helmet 1 is used to be worn on the user's head. The massage device is disposed on the helmet 1 and is used to achieve a massage on the user's head (e.g., acupoints on the head). The helmet 1 includes a front shell 11 and a rear shell 12. The front shell 11 and the rear shell 12 cooperatively define a head circumference space 13 mating with the user's head. The front shell 11 is for the forehead or hindbrain of the user and the rear shell 12 is for the hindbrain or forehead of the user. In this embodiment, the front shell 11 encompasses the user's forehead and the rear shell 12 encompasses the user's hindbrain.

The front shell 11 is in an arc form and is provided with slide plates 111 at both ends thereof. The rear shell 12 has an inner shell 121 and an exterior shell 122 both secured together. A relative closed shell cavity 123 is defined between the inner shell 121 and the exterior shell 122. Both the left and right ends of the shell cavity 123 define two insertion openings 124 respectively corresponding to the two slide plates 111. The two slide plates 111 are inserted into the shell cavity 123 of the rear shell 12 via the two insertion openings 124, separately. Preferably, stop portions are disposed at the two insertion openings 124 of the rear shell 12, for preventing the slide plates 111 from sliding away from the shell cavity. The front shell may be somewhat elastical and is easily adjusted. Certainly, the two slide plates could, alternatively, be disposed at the left and right ends of the rear shell, the front shell has a shell cavity and the two slide plates of the rear shell are inserted into the shell cavity of the front shell, separately.

Figure 9:
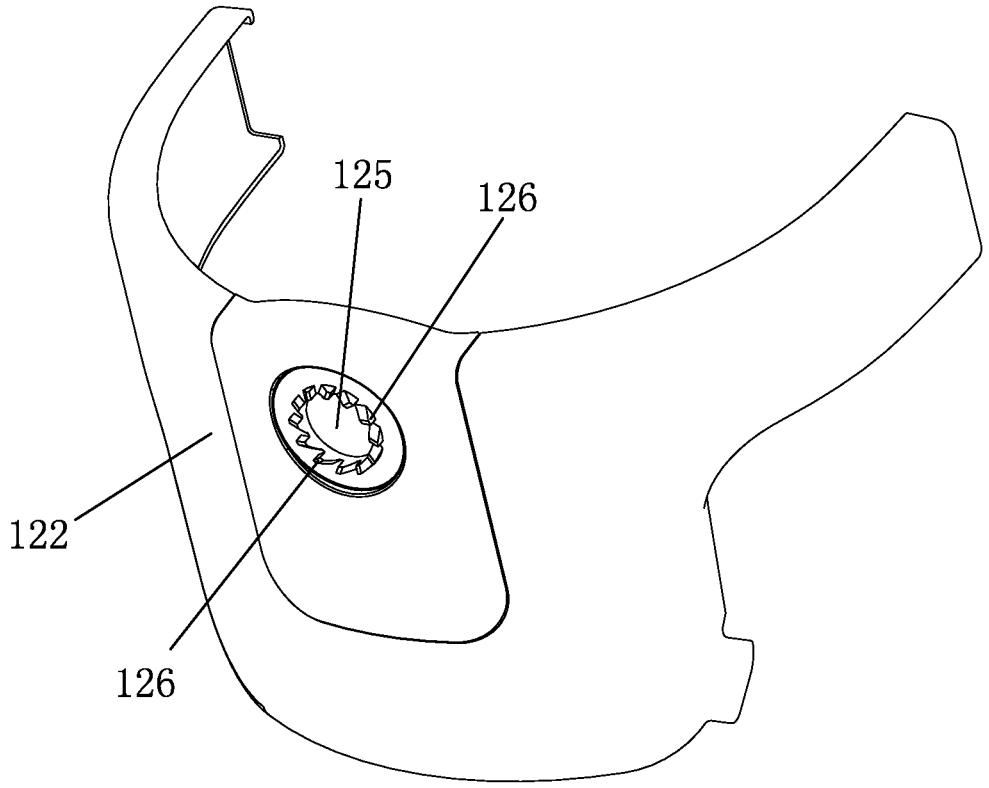

As shown in FIG. 9, a central portion of the exterior shell 122 defines an aperture 125 communicating with the shell cavity 123. The adjustment device 2 is mounted at the aperture 125. As shown in FIG. 4 through FIG. 8, the adjustment device 2 includes a knob 21, a fixing pole 22, a snap spring 23 and a winding ring 24. The knob 21 has an inner surface facing towards the snap spring 24 (facing towards the user's head) and an exterior surface facing away from the snap spring 24 (facing away from the user's head). A first through hole 211 is defined to axially penetrate through the inner surface and the exterior surface. Two mounting poles 212 with a certain height uprightly extend from a position on the exterior surface which is adjacent to the first through hole 211. Each mounting pole 212 is provided with a barb 213 at its top. The inner surface of the knob 21 is provided with a loop of first bulged teeth 214 uniformly surrounding the first through hole 211. The loop of first bulged teeth 214 acts as a first tooth ring. The knob 21 defines at least one anti-collision hole 215 penetrating through the inner surface and the exterior surface. Wall which defines the anti-collision hole 215 is provided with one locking bar 216 extending from the wall in a cantilever form. When adopting at least two anti-collision holes 215, namely at least two locking bars 216, the locking bars 216 are arranged along a clockwise direction or a counterclockwise direction.

The fixing pole 22 includes a head portion 221 with a relatively larger exterior diameter and a stem portion 222 with a relatively smaller exterior diameter. A neck portion 223 is formed at a joint of the head portion 221 and the stem portion 222. The head portion 221 defines at least two (e.g., two) discharging holes 224 and a bottom of the stem portion 222 has a threaded portion 225. The snap spring 23 includes an arc-shaped connection arm 231 and two fastening arms 232 extending from two ends of the connection arm 231. The two fastening arms 232 inwardly extend in a direction facing towards the connection arm 231 in parallel. Preferably, in a free status, a distance between the two fastening arms 232 is somewhat less than an exterior diameter of the stem portion 222, so that the fixing pole 22 can be elastically fastened through the fastening arms 232. The snap spring 23 may be formed by bending a metal block as a whole. An exterior diameter of the head portion 221 of the fixing pole 22 is preferably larger than a diameter of the first through hole 211, thereby preventing the knob 21 from being pull away from the fixing pole 22 when pulling the knob 21 outwardly (e.g., a direction facing away from the user's head, shown as an arrow in FIG. 18). Certainly, the exterior diameter of the head portion 221 could, alternatively, be equal to or less than the diameter of the first through hole. The knob can be sleeved back the fixing pole after being pulled away from the fixing pole.

As shown in FIG. 5, FIG. 15 through FIG. 18, the winding ring 24 includes a top portion 241 and a lower portion 242 which both have a relatively larger exterior diameter, and a winding pole 243 with a relatively smaller exterior diameter which is interposed between the top portion 241 and the lower portion 242 (namely, the winding ring 24 is big at both ends and small in the middle). The winding ring 24 further defines a second through hole 244 axially penetrating through the top portion, the winding pole and the lower portion. The top portion 241 of the winding ring 24 is provided with a loop of second bulged teeth 245 surrounding the second through hole 244. The loop of second bulged teeth 245 is correspondingly mating with the first bulged teeth 214 of the knob. The loop of second bulged teeth 245 acts as a second tooth ring.

The adjustment device 2 further includes a nut 25 which is disposed inside the shell cavity 123 of the rear shell 12 and is molded and fixed onto the inner shell 121 of the rear shell 12. The adjustment device further includes a knob cover 26 which engages with the knob 21 through a snap portion 261. This makes the entire adjustment device beautiful in appearance and easy to disassemble. The knob 21 may substantially appear to be a structure with an increasing exterior diameter from interior to exterior so as to facilitate pulling away the knob by the user.

As shown in FIG. 9, the exterior shell 122 of the rear shell is provided with a loop of locking teeth 126 surrounding the aperture 125, which is correspondingly mating with the locking bar 216 of the knob 21.

Figure 10:
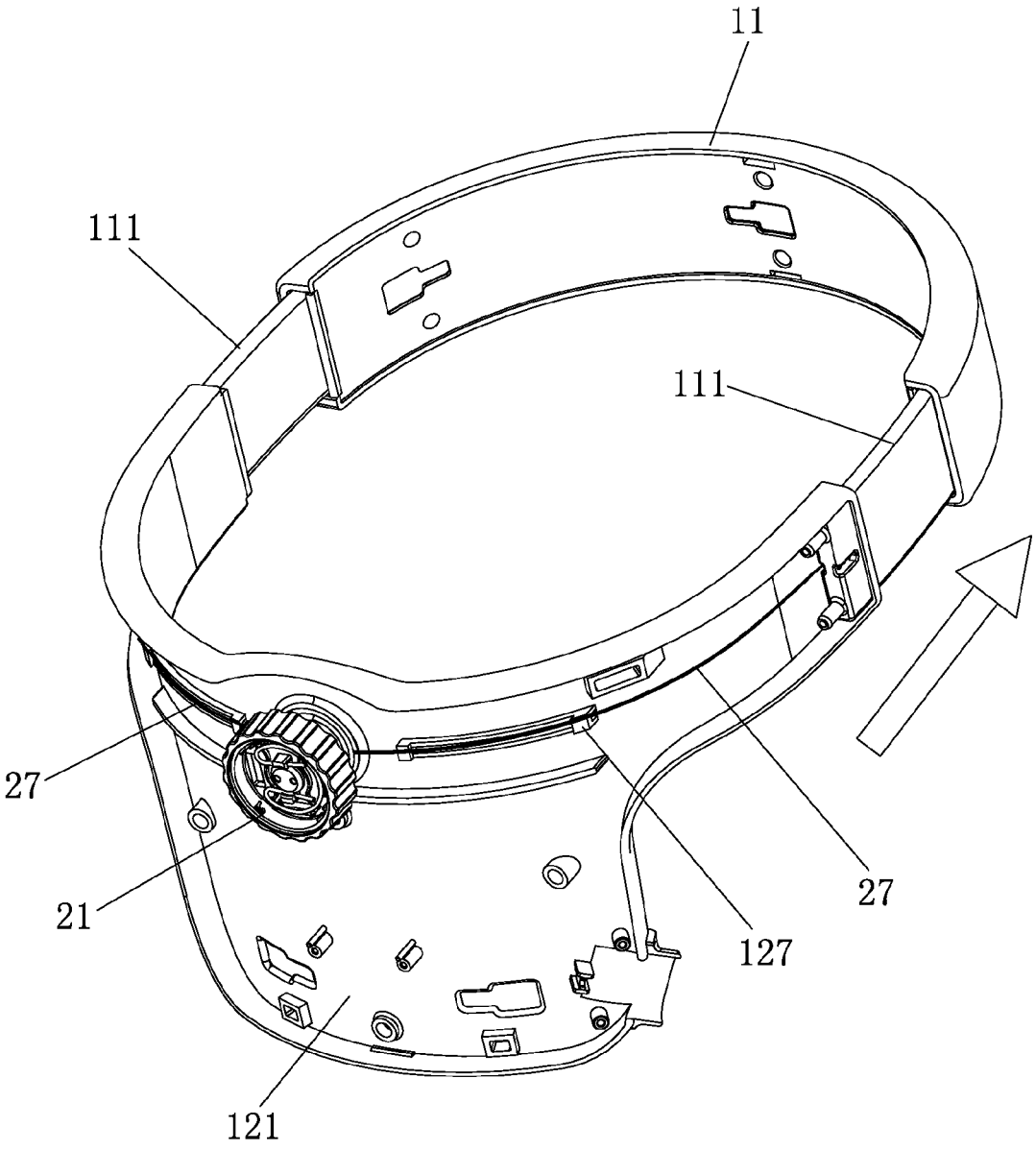
FIG. 10 is a perspective view of the head massager (no liner and inner shell) before adjusting in accordance with the embodiment of the present invention.
Figure 11:
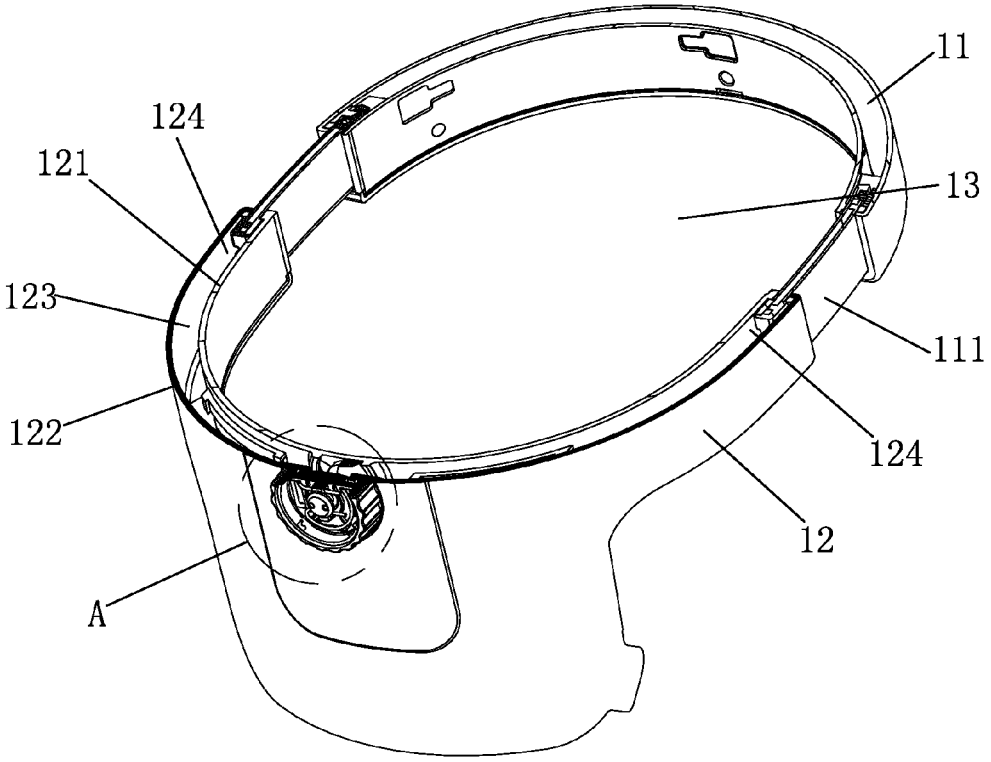
FIG. 11 is a sectional view of the head massager before adjusting (the knob engaging with the winding ring) in accordance with the embodiment of the present invention.
Figure 12:
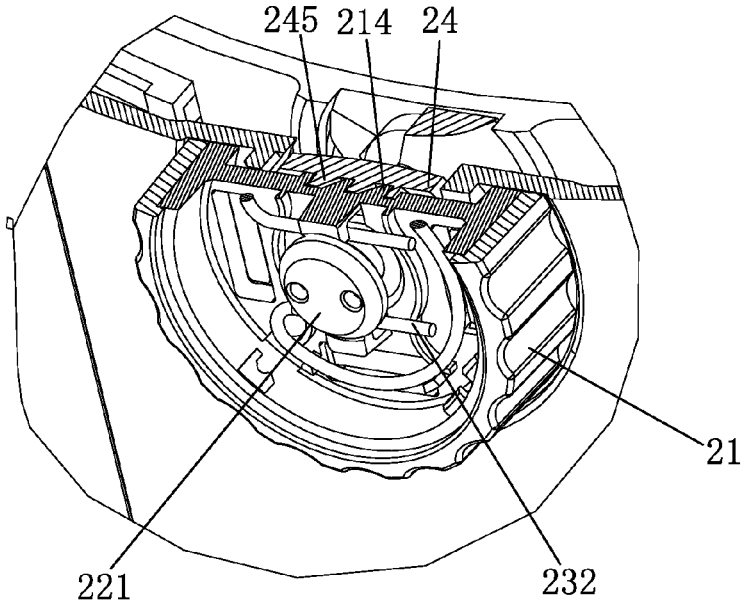
FIG. 12 is an enlarged view of part A of FIG. 11.
Figure 13:
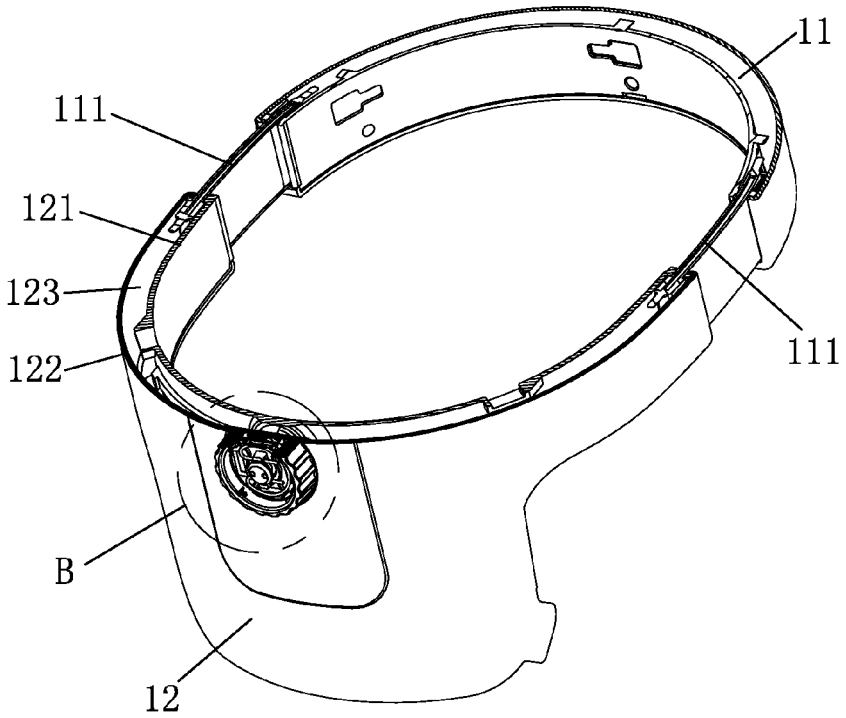
FIG. 13 is another sectional view of the head massager before adjusting (the knob engaging with the rear shell) in accordance with the embodiment of the present invention.
Figure 14:
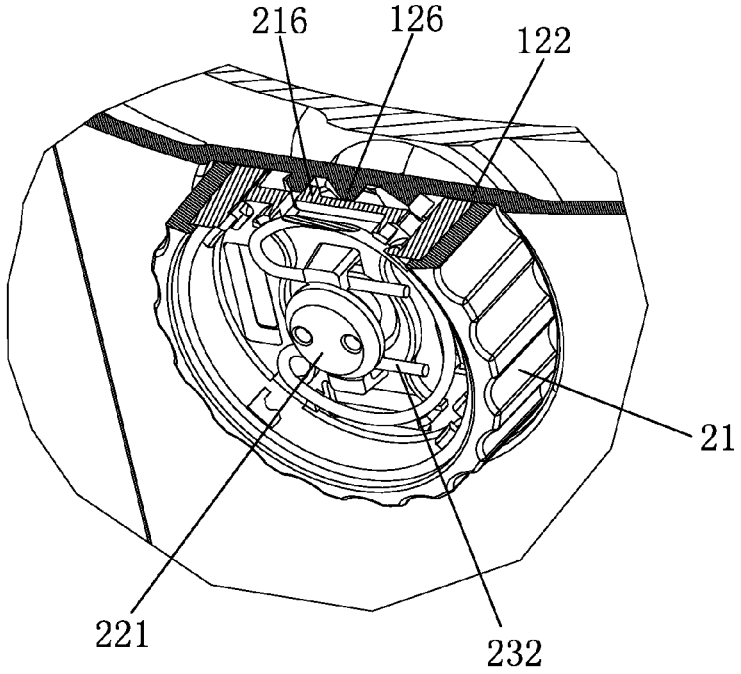
FIG. 14 is an enlarged view of part B of FIG. 13.
Figure 15:
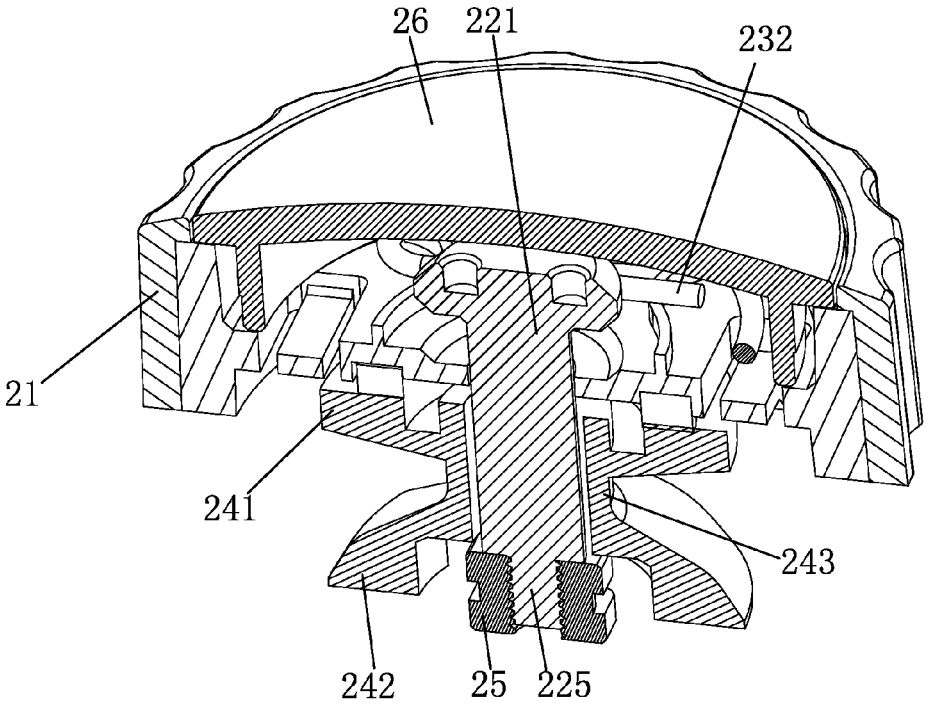
FIG. 15 is a perspective view of the adjustment device before pulling out the knob.
Figure 16:
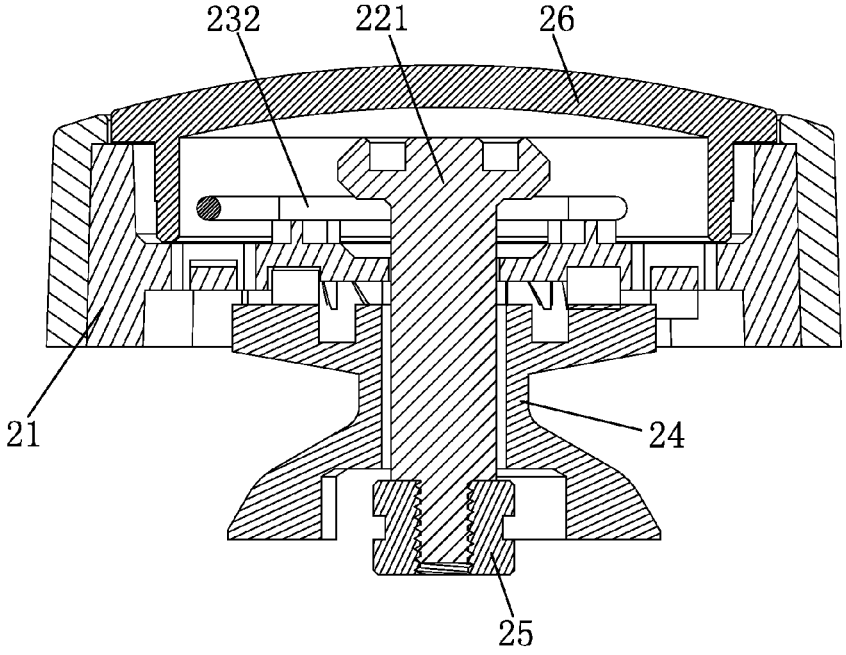
FIG. 16 is a cutaway view of the adjustment device before pulling out the knob.

As shown in FIG. 10, the adjustment device further includes two bundles of pulling ropes 27. One end of each bundle of pulling rope 27 is connected to a slide plate 111 of the front shell 11, and the other end of each bundle of pulling rope 27 is connected to the winding ring 24. Each bundle of pulling rope includes at least one rope, which is made of various materials according to design demands. The inner shell 121 is provided with at least one guide seat 127 for confining a running direction of the rope 27.

When assembling, the snap spring 23 is mounted on the two mounting poles 212 of the knob 21, and the barbs 213 of the mounting poles 212 are used for preventing the snap spring 23 from being pulling out. The knob 21 and the winding ring 24 are sleeved on the stem portion 222 of the fixing pole 22 via the first and second through holes 211, 244, respectively. The two fastening arms 232 of the snap spring 23 clamp the neck portion 223 of the fixing pole 22. Through the threaded portion 225, the bottom of the stem portion 222 is threaded to the nut 25 fixed on the inner shell 121, achieving fixation of the fixing pole 22 and the rear shell 12. Both the knob 21 and the winding ring 24 are loosely sleeved on the fixing pole 22 so that they can rotate along the fixing pole 22 and the knob 21 can also transfer along the fixing pole 22 inwardly and outwardly or up and down.

As shown in FIG. 11 through FIG. 16, before adjusting, the front shell 11 and the rear shell 12 of the helmet is in an initial pulled-away status, both the two slide plates 111 of the front shell 11 slide away from the shell cavity 123 of the rear shell 12, the head circumference space 13 is maximized at this point and the knob 21 is not pull out, namely, the first bulged teeth 214 of the knob 21 is mating with the second bulged teeth 245 of the winding ring 24, the locking bar 216 of the knob 21 is mating with the locking teeth 126 of the rear shell 12, and the two fastening arms 232 of the snap spring 23 clamp the neck portion 223 of the fixing pole 22. When adjusting size of the head circumference space 13, rotating the knob 21 in a positive direction, the winding ring 24 with the second bulged teeth 245 is rotated by the first bulged teeth 214 to make the two bundles of pulling ropes to be retract and wound on the winding ring 24. The two bundles of pulling ropes 24 simultaneously pull the front shell 11 so that the front shell 11 is pulled towards the rear shell 12 (the slide plate of the front shell 11 slides into the shell cavity 123 of the rear shell 12), accordingly compressing the head circumference space 13. After adjusting to a desired position, since the locking bar of the knob is mating and fastened to the locking teeth of the rear shell, thereby preventing the knob from rotating in a reverse direction.

Figure 17:
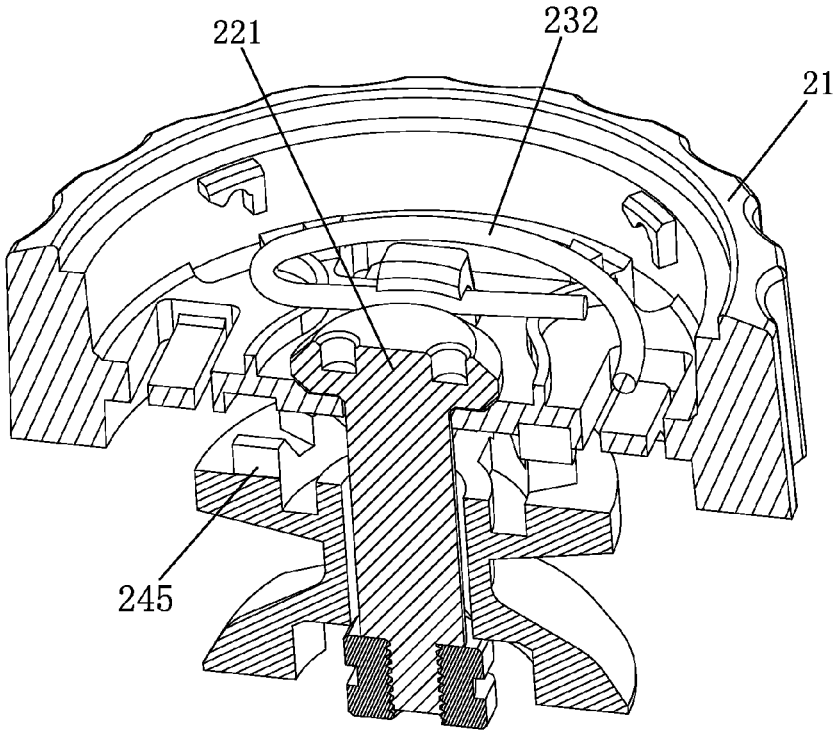
FIG. 17 is a perspective view of the adjustment device after pulling out the knob.
Figure 18:
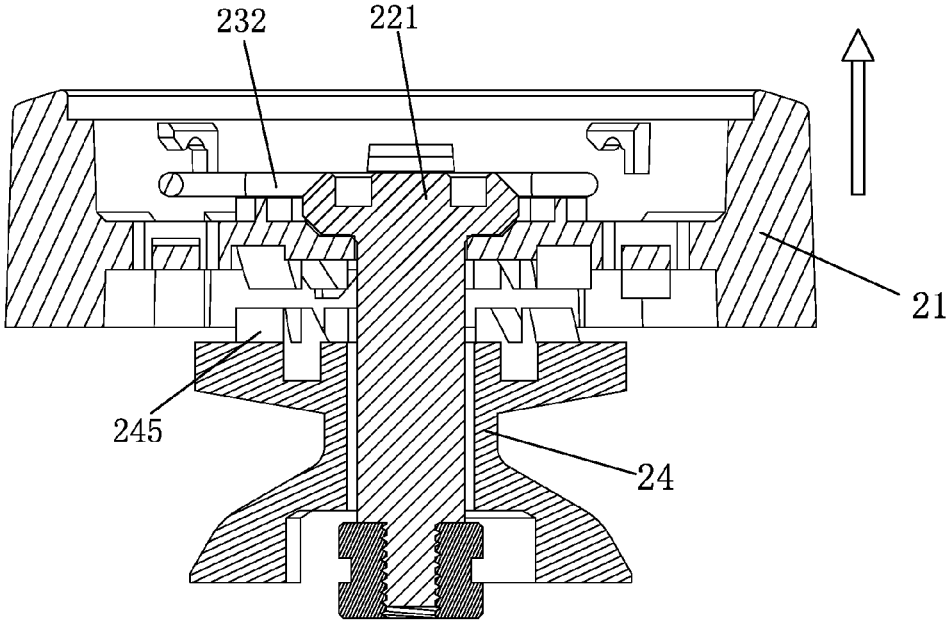
FIG. 18 is a cutaway view of the adjustment device after pulling out the knob.

As shown in FIG. 10, FIG. 17 and FIG. 18, for making the helmet return back the initial pulled-away status, pulling out the knob 21 along a direction facing away from the user's (e.g., outwardly), the first bulged teeth 214 of the knob 21 is departed from the second bulged teeth 245 of the winding ring 24 and the locking bar 216 of the knob 21 is departed from the locking teeth 126 of the rear shell 12. At this point, the pulling ropes 27 are in a free and loose status, the user can pull the front shell 11 away from the rear shell 12 by hand (pulling direction shown as an arrow in FIG. 10). The slide plate 111 of the front shell 11 is pulled away from the shell cavity 123 of the rear shell 12 during pulling.

Figure 3:
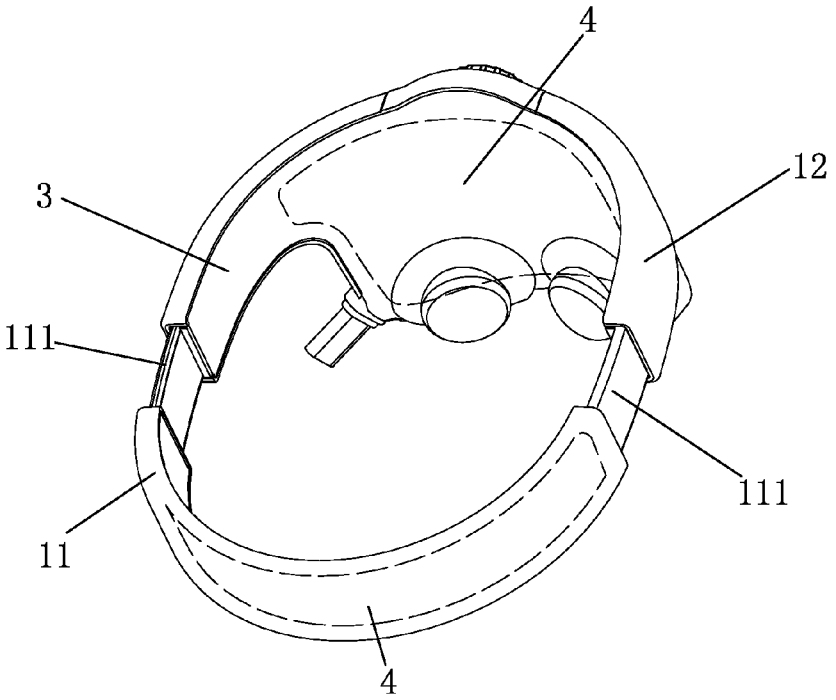
Figure 4:
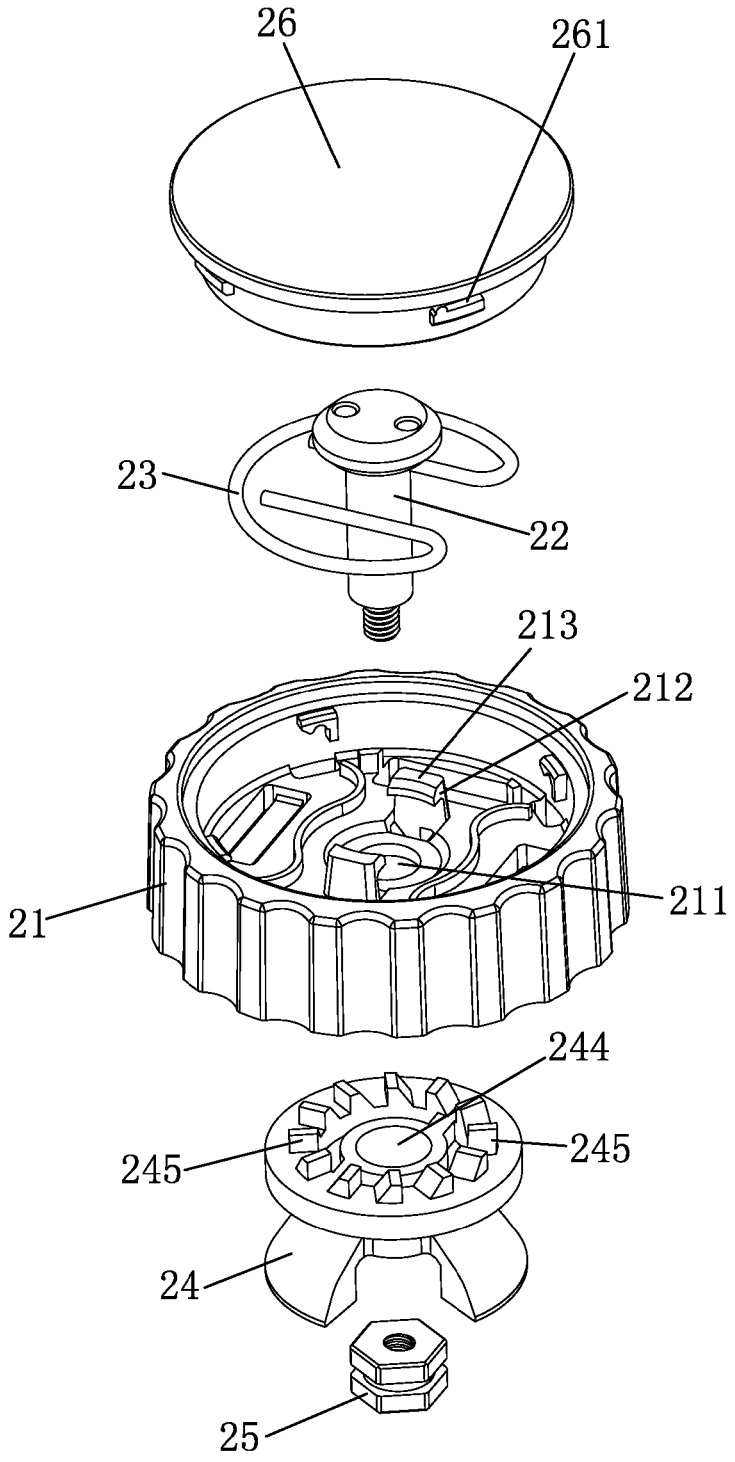
FIGS. 4 and 5 are exploded, perspective views of an adjustment device from two angles of view in accordance with the embodiment of the present invention.
Figure 5:
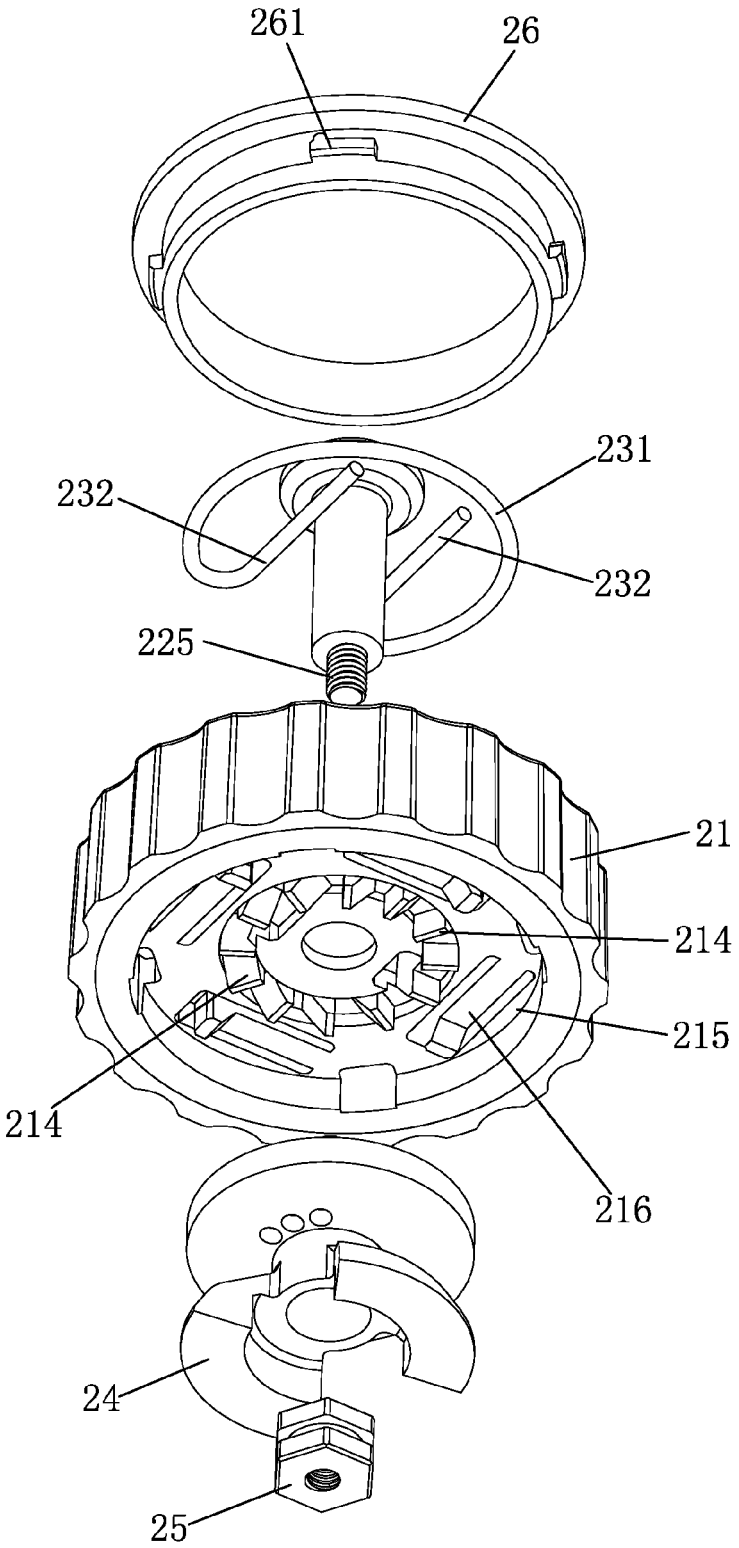
Figure 6:
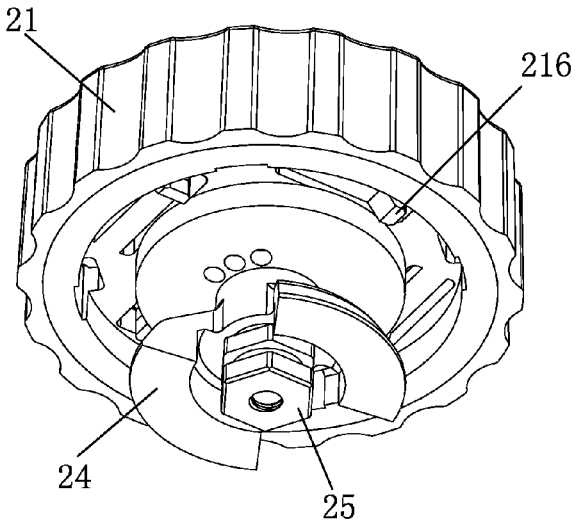
FIG. 6 is a perspective view of the adjustment device in accordance with the embodiment of the present invention.
Figure 7:
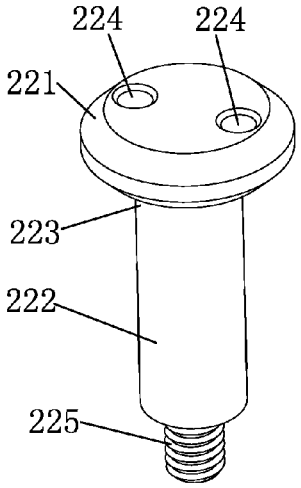
FIGS. 7, 8 and 9 are perspective views of a fixing pole, a knob and a surface shell respectively in accordance with the embodiment of the present invention.
Figure 8:
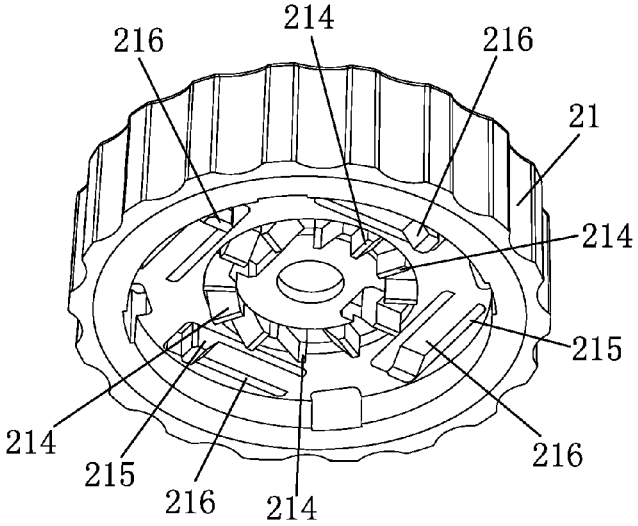
Figure 19:
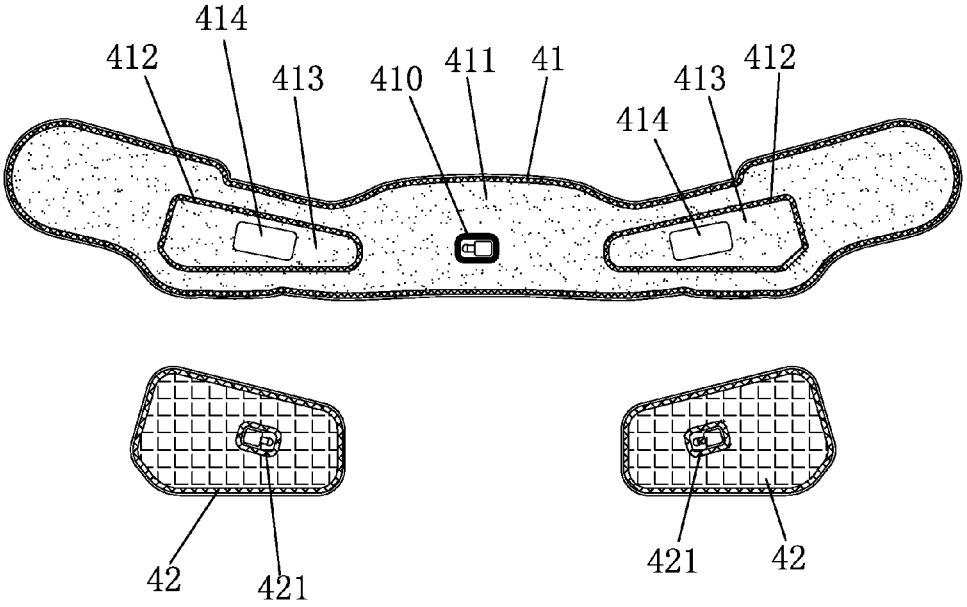
FIG. 19 is a disassembled view of air bags before assembling in accordance with the embodiment of the present invention.
Figure 20:
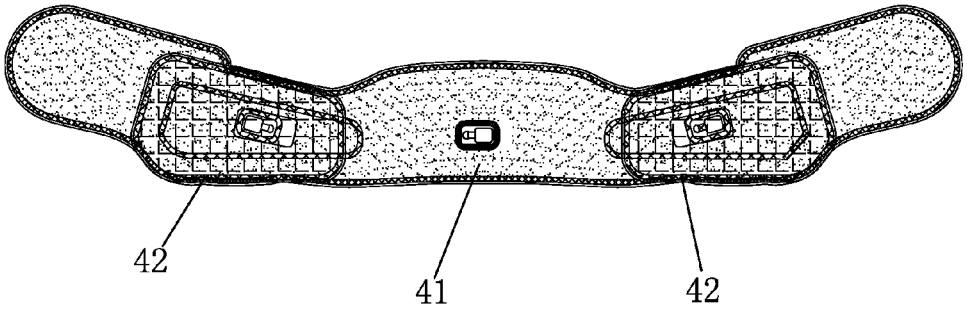
FIG. 20 is a front view of the air bags in accordance with the embodiment of the present invention.

As shown in FIG. 3, FIG. 19 and FIG. 20, the head massager further includes a flexible liner 3 disposed on the internal sides of the front shell and the rear shell. The massage device includes an air bag 4 which is disposed inside the liner 3. The air bag 4 includes a first air bag 41 and two second air bags 42 corresponding to the user's left and right temples respectively. The first air bag 41 has a first gas nozzle 410, a gas intaking portion 411 and two mounting portions 413 which are completely separated from the gas intaking portion 411 through separate tapes 412 and gas cannot enter into. Both the two mounting portions 413 have fastening holes 414. Both the two second air bags 42 have second gas nozzles 421 and are disposed on an internal side of the first air bag 41. The second gas nozzles 421 of the two second air bags 42 are fastened to rims of the two fastening holes 414 by exterior edges thereof so that the second air bags 42 engages with the first air bag 41 and the two second air bags 42 can rotate along their gas nozzles. A surface area of the second air bag is preferably such as to cover the entire temple. Certainly, the liner 3 could alternatively be in a close ring form around the front and rear shells.

For achieving a gas pressure massage through the air bags, the first air bag 41 produces a certain massage action for the temple when being inflated. When inflating the two second air bags 42, their inflating actions directly knead the temples, thereby forming double massage actions for the temples and increasing massage effect. Further, since the gas intaking portion and the mounting portions are separated from each other, mounting areas for mounting the second air bags are effectively enlarged to further improve the pressure massage effect.

The front and rear shells both are configured in a longitude direction on the head and the adjustment device is used for adjusting size of the head circumference space in a longitude direction. Certainly, when the front and rear shells both are configured in a latitude direction on the head and the adjustment device is used for adjusting size of the head circumference space in a latitude direction. When the helmet has both the longitude and latitude shells and two adjustment devices are used for adjusting size of the head circumference space in the longitude and latitude directions. The massage device includes air bags which are provided with gas by a gas source, thereby achieving a gas pressure massage on the user's head (e.g., acupoints on the head) by controlling inflation and deflation of the air bags. Certainly, the massage device may alternatively utilize a hot pressing massage device, a vibration massage device (bias vibration through a vibration motor), a magnetic massage device and so on, or a combination of two or more massage devices which are applied in an exiting head massager or eye massager. The adjustment device may be disposed on the rear shell so as to pull the front shell. The adjustment device may alternatively be disposed on the front shell so as to pull the rear shell. Certainly, the head massager may also act as an eye massager for achieving a massage for eyes.

When not pulling out the knob, the snap spring snaps to the neck portion of the fixing pole. When pulling the knob outwardly, the snap spring is pulled outwardly along with the knob so that the snap spring is departed from the neck portion and snaps to the head portion of the fixing pole and there comes a "bang" sound which has an indication function for remindering the user of its motion in position, as well as improving feeling of operation. Conversely, a sound indication also occurs when the knob is pressed down again after being pulled out.

Since the knob is mating with the winding ring through the first and second bulged teeth, the air bags will generate a large pressure during inflating when the massage device uses the air bags, for preventing the knob rotates reversely, a reverse locking device is provided for producing a restriction of the reverse rotation. In the reverse locking device, for example the locking bars on the knob and the locking teeth on the rear shell as described above, all the locking bars are mating with the locking teeth in turn in a position direction while rotating the knob in the position direction. The position direction could be, e.g., a clockwise direction or a counterclockwise direction.

Through at least two discharging holes defined in the fixing pole, the fixing pole may be removed from the rear shell only by a specific tool, thereby preventing the user from unduly removing.

The head massager may further include a control casing arranged to be apart from the helmet for controlling the massage device through the control casing. Two bundles of pulling ropes, as a length adjustment device, may be connected to an identical winding ring. Alternatively, two bundles of pulling ropes could be connected to two winding rings which rotate synchronously, respectively. In this way, the two winding rings may be sleeved on an identical fixing pole.

The above-mentioned is only to further explain the present invention in detail with reference to preferred embodiments, but places no limit to the invention. Any ordinary skilled in the art can carry out various modifications, equivalent replacements etc without departing from the spirit and principle of the present invention, and these modifications, equivalent replacements etc shall be within the protective scope of the present invention.

What is claimed is:

1. A head massager comprising a helmet and a massage device disposed on the helmet, the helmet having a front shell and a rear shell which is movable relating to the front shell, wherein: further comprising an adjustment device, the rear shell having a shell cavity, two ends of the front shell being plug-connected with two ends of the rear shell, the adjustment device comprising a positive rotatable knob, a fixing pole, a winding ring, two bundles of pulling ropes and a reverse locking device for preventing the knob from rotating reversely, the fixing pole being fixed on the rear shell, both the knob and the winding ring being loosely sleeved on the fixing pole through through holes, the knob being provided with a loop of first bulged teeth around the through hole thereof and the winding ring being provided with a loop of second bulged teeth around the through hole thereof correspondingly, the first bulged teeth and the second bulged teeth having a mating status and a separated status, one end of each bundle of pulling rope being connected to one end of the front shell, and the other end of each bundle of pulling rope being connected to the winding ring so that both the two bundles of pulling ropes pull the front shell while the first bulged teeth engages with the second bulged teeth and the knob rotates along a positive direction.

2. The head massager according to claim 1, wherein the knob is provided with a mounting pole and the adjustment device further comprises a snap spring which is mounted on the mounting pole, the snap spring having two resilient fastening arms which clamp the fixing pole.

3. The head massager according to claim 2, wherein the fixing pole comprises a head portion with a larger exterior diameter and a stem portion with a smaller exterior diameter, a neck portion being formed at a joint of the head portion and the stem portion, the two fastening arms of the snap spring clamping the neck portion, the stem portion being fixed to the rear shell, the knob and the winding ring being loosely sleeved on the stem portion.

4. The head massager according to claim 3, wherein the rear shell comprises an inner shell and an exterior shell secured together, a shell cavity being defined between the inner shell and the exterior shell, both ends of the front shell being provided with a slide plate which is inserted into the shell cavity, the pulling rope being connected to the slide plate, the adjustment device further comprising a nut, the stem portion being provided with a threaded section, the nut being fixed to the inner shell, the threaded section of the stem portion being threaded to the nut.

5. The head massager according to claim 4, wherein the mounting pole have two through holes surrounding the knob, a top of each mounting pole being provided with a barb, the snap spring being sleeved on the two mounting poles.

6. The head massager according to claim 5, wherein the snap spring comprises an arc-shaped connection arm, the two fastening arms being connected through the connection arm and the two fastening arms inwardly extending in a direction facing towards the connection arm in parallel.

7. The head massager according to claim 6, wherein the knob is covered by a knob cover.

8. The head massager according to claim 1, wherein the rear shell has an aperture communicating with the shell cavity, the fixing pole and the winding ring being installed into the shell cavity via the aperture, the knob being at least partially disposed outside the shell cavity, the reverse locking device comprising at least one locking bar disposed on the knob and a loop of locking teeth disposed on the rear shell around the aperture, the locking bar engaging with the locking teeth.

9. The head massager according to claim 8, wherein the knob defines at least two anti-collision holes surrounding the through hole thereof, one locking bar in a cantilever form extending from each wall which defines the anti-collision hole.

10. The head massager according to claim 1, wherein at least one of the front shell and the rear shell is provided with a flexible liner fixed to an internal side thereof, an air bag comprising a first air bag and two second air bags is provided within the liner, the first air bag defining two fastening holes, and the two second air bags being disposed on an internal side of the first air bag, gas nozzles of the two second air bags being fastened to rims of the two fastening holes, respectively.

11. The head massager according to claim 10, wherein the first air bag comprises a gas intaking portion and mounting portions all separated from the gas intaking portions through separate tapes, the fastening holes being defined in the mounting portions.

12. A helmet of a head massager, comprising a front shell and a rear shell which is movable relating to the front shell, wherein: further comprising an adjustment device, the rear shell having a shell cavity, two ends of the front shell being plug-connected with two ends of the rear shell, the adjustment device comprising a positive rotatable knob, a fixing pole, a winding ring, two bundles of pulling ropes and a reverse locking device for preventing the knob from rotating reversely, the fixing pole being fixed on the rear shell, both the knob and the winding ring being loosely sleeved on the fixing pole through through holes, the knob being provided with a loop of first bulged teeth around through hole thereof, the winding ring being provided with a loop of second bulged teeth around through hole thereof correspondingly, the first bulged teeth and the second bulged teeth having a mating status and a separated status, one end of each bundle of pulling rope being connected to one end of the front shell and the other end of each bundle of pulling rope being connected to the winding ring so that both the two bundles of pulling ropes pull the front shell while the first bulged teeth engages with the second bulged teeth and the knob rotates along a positive direction.

13. The helmet of the head massager according to claim 12, wherein the knob is provided with a mounting pole and the adjustment device further comprises a snap spring which is mounted on the mounting pole, the snap spring having two resilient fastening arms which clamp the fixing pole.

14. The helmet of the head massager according to claim 13, wherein the fixing pole comprises a head portion with a larger exterior diameter and a stem portion with a smaller exterior diameter, a neck portion being formed at a joint of the head portion and the stem portion, the two fastening arms of the snap spring clamping the neck portion, the stem portion being fixed to the rear shell, the knob and the winding ring being loosely sleeved on the stem portion.

15. The helmet of the head massager according to claim 14, wherein the rear shell comprises an inner shell and an exterior shell secured together, a shell cavity being defined between the inner shell and the exterior shell, both ends of the front shell being provided with a slide plate which is inserted into the shell cavity, the pulling rope being connected to the slide plate, the adjustment device further comprising a nut, the stem portion being provided with a threaded section, the nut being fixed to the inner shell, the threaded section of the stem portion being threaded to the nut.

16. The helmet of the head massager according to claim 15, wherein the mounting pole have two through holes surrounding the knob, a top of each mounting pole being provided with a barb, the snap spring being sleeved on the two mounting poles, the snap spring comprising an arc-shaped connection arm, the two fastening arms being connected through the connection arm and the two fastening arms inwardly extending in a direction facing towards the connection arm in parallel.

17. The helmet of the head massager according to claim 12, wherein the rear shell has an aperture communicating with the shell cavity, the fixing pole and the winding ring being installed into the shell cavity via the aperture, the knob being at least partially disposed outside the shell cavity, the reverse locking device comprising at least one locking bar disposed on the knob and a loop of locking teeth disposed on the rear shell around the aperture, the locking bar engaging with the locking teeth.

18. The helmet of the head massager according to claim 17, wherein the knob defines at least two anti-collision holes surrounding the through hole thereof, one locking bar in a cantilever form extending from each wall which defines the anti-collision hole.

19. The helmet of the head massager according to claim 12, wherein at least one of the front shell and the rear shell is provided with a flexible liner fixed to an internal side thereof, an air bag comprising a first air bag and two second air bags is provided within the liner, the first air bag defining two fastening holes, and the two second air bags being disposed on an internal side of the first air bag, gas nozzles of the two second air bags being fastened to rims of the two fastening holes by exterior edges thereof, respectively.

* * * * *